US012715031B2

(12) United States Patent
Bühler et al.

(10) Patent No.: US 12,715,031 B2
(45) Date of Patent: Aug. 25, 2026

(54) METHOD FOR MONITORING SEALER

(71) Applicant: FERRUM PACKAGING AG, Schafisheim (CH)

(72) Inventors: Oliver Bühler, Aeschi (CH); Gerhard Rohr, Buchs (CH)

(73) Assignee: FERRUM PACKAGING AG, Schafisheim (CH)

( * ) Notice: Subject to any disclaimer, the term of this patent is extended or adjusted under 35 U.S.C. 154(b) by 463 days.

(21) Appl. No.: 18/218,517

(22) Filed: Jul. 5, 2023

(65) Prior Publication Data

US 2024/0024945 A1 Jan. 25, 2024

(30) Foreign Application Priority Data

Jul. 19, 2022 (EP) ..... 22185612

(51) Int. Cl.
*B65B 7/00* (2006.01)
*B21D 51/26* (2006.01)
*B21D 51/32* (2006.01)

(52) U.S. Cl.
CPC ..... *B21D 51/32* (2013.01); *B21D 51/2661* (2013.01)

(58) Field of Classification Search
CPC ..... B21D 51/26
See application file for complete search history.

(56) References Cited

U.S. PATENT DOCUMENTS 4,574,607 A * 3/1986 Akino ..... B21D 51/32 72/476
11,007,562 B2 5/2021 Gillest et al.
2007/0017593 A1* 1/2007 Bernhard ..... B65C 9/40 141/2
2018/0222619 A1* 8/2018 Ehrmann ..... B65B 51/10

FOREIGN PATENT DOCUMENTS

WO 2009047658 A2 4/2009

OTHER PUBLICATIONS

European Search Report issued Jan. 30, 2023 in corresponding European Application No. 22185612.3.

* cited by examiner

*Primary Examiner* — Paul B Yanchus, III
(74) *Attorney, Agent, or Firm* — Spencer Fane, LLP

(57) ABSTRACT

A method for monitoring seaming tools of a sealer includes providing the sealer with a seaming tool to attach a lid to a container and a controller to control and monitor the sealer, the seaming tool including an identification element by which the seaming tool is capable of being uniquely identified, identifying the seaming tool by the identification element, storing the identification of the seaming tool in the controller, and monitoring a number of containers sealed by the seaming tool by the identification stored in the controller.

16 Claims, 2 Drawing Sheets

METHOD FOR MONITORING SEALER

CROSS-REFERENCE TO RELATED APPLICATION

This application claims priority to European Patent Application No. 22135612.3, filed Jul. 19, 2022, the contents of which are hereby incorporated by reference in its entirety.

BACKGROUND

Technical Field

The disclosure relates to a method for monitoring seaming tools of a sealer. The disclosure further relates to a sealer for carrying out the method according to the disclosure.

Background Information

During the filling of beverage cans or food cans, the cans pass through a can sealer after being filled with the beverage or foodstuff, whereby the filled cans enter via a feed path and can lids enter via a further feed path. The can sealer usually has several similar arrangements arranged in a carousel shape, in each of which a can is sealed with a can lid. The can lids are guided onto the cans and held on the can by a seaming head. This holding also series to fix the cans against breaking out of the circular path passed by the cans in the can sealer due to the centrifugal force. In the can sealer, the can with the can lid is seamed over a seaming roller at the edges and thus sealed. Normally, the can with the can lid is additionally rotated around its own axis of symmetry by the seaming head. For rotation, the seaming rollers and seaming heads are arranged on a respective seaming shaft or a seaming roller pin.

A generic can sealer is described in DE749636 and DE4234115 A1. The can sealer comprises a clamping device for receiving a can to be sealed. In the operating state, the can to be sealed is introduced into the clamping device and secured by the clamping device in axial and radial directions. A can lid is also introduced centered over the can opening of the can to be sealed. The can has a circumferential can flange in the area of the can opening and the can lid has a circumferential can lid flange. For sealing the can opening with the can lid, the can sealer additionally comprises two seaming rollers, mounted rotatably about an axis in each case, which seaming rolls press the can flange and the can lid flange together by a force acting substantially radially, the pressing being effected by a continuous rolling in the circumferential direction along the circumference of the can opening.

A further can sealer is known from GB 2098899 A. The can sealer comprises a clamping device for receiving the can to be sealed and a seaming roller. In the operating state, the can to be sealed is introduced into the clamping device and secured by the clamping device in the axial and radial directions. A can lid is also introduced centered over the can opening of the can to be sealed. The can has a circumferential can flange in the area of the can opening of the can body and the can lid has a circumferential can lid flange.

SUMMARY

For sealing the cans, seaming tools are required, which comprise inter ilia the seaming rollers and seaming heads mentioned above. It has been determined that seaming tools deform the metal of the can and lid and are therefore subject to wear caused by pressure and friction. Thus, the seaming tools need to be replaced from time to time. An important quality feature of seaming rollers is the number of cans guaranteed by the manufacturer that can be sealed with this seaming roller.

If the data is recorded properly, the number of sealed cans of a seaming roller can be roughly determined and the wear of the seaming tools can be roughly monitored. However, this requires manual recording by the user.

Thus, there is no reliable way to monitor the wear of seaming tools.

It is therefore an object of the disclosure to provide a method for monitoring seaming tools of a sealer and a sealer which avoid the adverse effects known from the state of the art.

In particular, it should be made possible to monitor the wear of seaming tools of a sealer accurately and reliably.

The object is met by a method according to the disclosure for monitoring seaming tools of a sealer and a sealer for carrying out the method according to the disclosure.

According to the disclosure, a method for monitoring seaming tools of a sealer is proposed. The method according to the disclosure comprises the provision of a sealer with a seaming tool (or also several seaming tools) for attaching a lid to a container and a control device for controlling and monitoring the sealer, wherein the seaming tool comprises an identification element by which the seaming tool can be uniquely identified (i.e., in particular can be distinguished from all other seaming tools). In addition, the method according to the disclosure comprises identifying the seaming tool by the identification element and storing the identification (also identifying) of the seaming tool in the control device and monitoring a number of containers sealed by the seaming tool by the identification stored in the control device.

The method according to the disclosure makes it possible to assign to the (in particular each) seaming tool in the control system the number of containers sealed with it. For this purpose, the (in particular each) seaming tool can be machine-readably marked by the identification element. Before the sealer is activated for production, all the seaming tools installed during an initialization can be identified and stored in the control system, i.e., the control device. A counter can therefore be stored for the fin particular each) seaming tool.

In an embodiment of the disclosure, the sealer can comprise an identification device. Which is moved to the identification element and identifies the seaming tool by the identification element.

The identification element can be a transponder. In particular, the transponder can be a passive transponder, and the identification device can be designed as a transmitting/receiving unit and can provide energy to the passive transponder for identification.

As an alternative or in addition, the identification element can be an opto-electronically readable identification element. The identification device can be an opto-electronic reading device and can read the opto-electronically readable identification element for identification. Preferably, the opto-electronically readable identification element can be a bar code or a QR code. In this context, a bar code or also barcode can be understood as an opto-electronically readable font consisting of parallel bars and gaps of different widths. Here, the term code stands for the representation of data in binary symbols.

Each seaming tool can have the transponder/the identification element at the same location of a stator (i.e., a static/immobile part of the seaming tool in the operating state/when sealing the container). Since increased hygiene requirements are to be fulfilled in a working space of the sealer, the identification device can be recessed in an upper part of the sealer and only enter the working space when the identification of the seaming tools is carried out. The identification device can thus be arranged on the sealer in such a way that it can be introduced into the working space.

In an embodiment of the disclosure, a limit value for sealed containers can be stored in the control device and a wear signal can be output via the control device after the limit value for the seaming tool is reached. This wear signal can either inform the user and/or stop the sealer, in order to allow a timely replacement/a timely inspection of the seaming tools.

The seaming tool can comprise a seaming shaft rotatable about a seaming axis and a seaming means or device arranged at one end of the seaming shaft. The seaming means can be arranged in a detachable manner at one end of the seaming shaft. Particularly preferably, the method according to the disclosure refers to the seaming means, i.e., the seaming means can be uniquely identified by the identification element, i.e., the seaming means is identified by the identification element and the identification of the seaming means is stored in the control device so that the number of containers sealed by the seaming means can be monitored by the identification stored in the control device.

The monitoring of the number of containers sealed by the seaming tool can be carried out by a rotation measurement at the seaming shaft. For this purpose, the identification device can be designed as a rotation sensor arranged on the seaming shaft for measurement, such as a, gyrometer. However, as an alternative, the rotations of the rotor can also be counted (one can per station is sealed with each rotation of the rotor).

The seaming shaft can be a seaming head shaft and the seaming means can be a seaming head for fixing the lid on the container. As an alternative or in addition, the seaming shaft can be a seaming roller shaft (also seaming roller pin) and the seaming means can be a seaming roller for seaming the lid to the container.

Each seaming roller can have the transponder at the same point on the stator. Since increased hygiene requirements are to be fulfilled in the working space, the identification device is preferably movable and recessed in the upper part of the sealer in such a way that it can be moved into the product space when the identification of the seaming rollers is carried out.

Preferably, only the rotor (as a movement device of a carousel-shaped arrangement) of the sealer can be rotated for the identification, so that no containers are wasted for the identification (i.e., the remaining device parts of the sealer stand still). The rotor of the sealer can therefore be moved "empty". Once the identification has been completed, the sealing process can be started while the identification device is still being moved out of the working space/into the upper part.

In a particularly preferred embodiment of the disclosure, the monitoring of the number of containers sealed by the seaming tool can be carried out by counting the lids by a lid de-stacking device of the sealer. This means that the sealer comprises the lid de-stacking, device, which separates the lids from a lid stack, after which the lids are then fed to the container. The lids are counted during the separation process.

Thus, due to the lid de-stacking, device, the sealer knows in particular exactly how many containers have been sealed. If the sealer is stopped after a production run, the counters of the individual seaming means (preferably seaming rollers) can be increased by the corresponding number of containers, in consideration of a total number of seaming means/a number of sealing stations of the sealer. For example: if the sealer has 14 seaming stations and 1.4 million containers were sealed in a production run, 100,000 sealed containers are assigned to each seaming roller.

In principle, the identification of the seaming tools can be carried out when the sealer is started to check whether new seaming tools have been used. In the case of short stops of less than 10 minutes, which are caused for example by an error, preferably no new identification is carried out at restart.

If the seaming tool such as the seaming roller is replaced, the control device can preferably note this in a log file. A new counter is automatically started for each replaced seaming tool/replaced seaming roller. The data of the old seaming tool/old seaming roller is preferably retained in the control system. If the replaced seaming roller is used again, the control device notices this and assigns the sealed containers to this seaming roller again, i.e., the counter is continued.

Due to the method according to the disclosure, in particular, reliable information can also be obtained on the service life of the seaming tools. Thereby, the data can be analyzed to update the number of the containers to be sealed and, in particular, can also be stored in a cloud and distributed to control devices.

According to the disclosure, a sealer for sealing the containers with the lid is further proposed, which sealer is used for carrying out the method according to the disclosure.

The sealer can comprise a seaming tool for attaching the lid to the container and the control device for controlling and monitoring the sealer, wherein the seaming tool comprises the identification element, by which identification element the seaming tool can be uniquely identified. In addition, the sealer can comprise the (carousel-shaped) arrangement arranged in the working space of the sealer with a plurality of sealing stations comprising the seaming tool.

For feeding the containers to the arrangement, a feeding device can be arranged on the arrangement. In addition, the sealer can comprise an outlet for sealed containers (with the lid) from the arrangement.

Preferably, the sealer also comprises a lid feeder which guides lids from the de-stacking device of the lid stack until they are transferred onto the container. After the de-stacking process, in which the lids are separated individually from a stack by the de-stacking device, the lids are thus guided to the container. The lid feeder can be arranged in the working space of the sealer below the de-stacking device.

The sealing of the container can comprise positioning the container on a lifting station of the sealing station and seaming the lid to the container by the seaming roll and the seaming head. Finally, the sealed container can be discharged from the working space of the sealer.

The working space is the space of the sealer in which the container is preferably sealed with the lid, in particular the space in which a seaming process takes place. Preferably, the working space is surrounded by a housing and thus delimits the working space of the sealer (and thus enables the formation of a hygiene zone).

In particular, the housing can be considered as a cladding, enclosure, casing, or sheath which at least partially surrounds the working space. The housing can close off and/or shield the working space from the outside, so that an atmosphere in the working space is hygienically separated from the environment.

The sealing station can comprise a sealing head for sealing the container with the lid. The sealing head can comprise the seaming means for seaming the lid to the container. The seaming means can be the seaming roller and the seaming head. The, or each sealing head can therefore comprise at least one seaming roller (particularly preferably two seaming rollers) and one seaming head. The sealing head can comprise seaming shafts or seaming roller pins rotatable about a seaming axis, wherein the seaming means is arranged at one end of the respective seaming shall/the respective seaming roller pin (seaming head and seaming roller can therefore be rotated in particular via the respective seaming shaft/the respective seaming roller pin).

In particular, two seaming rollers can be arranged on one seaming lever, one seaming roller for a first seaming operation and one seaming roller for a second seaming operation. However, the first and the second seaming roller can also be arranged on a separate seaming lever. The sealer according to the disclosure or the arrangement, respectively, can further comprise the lifting station (or a plurality of lifting stations) for lifting the container. The lifting stations can be arranged in the arrangement opposite the sealing heads.

The sealer according to the disclosure is preferably designed as a can sealer. Here, the container can be a can and the lid can be a can lid, which are seamed together by the can sealer. The can sealer usually has as an arrangement several similar sealing stations (of preferably sealing heads and lifting stations) arranged in a carousel shape, in which a can is sealed in each case with a can lid.

In the operating state of the can sealer, the seaming rollers with their respective seaming profile are brought into contact with a can lid flange of the can lid and a can flange of the can. By rotating the can, the seaming roller is then rotated in the circumferential direction of the can, thereby seaming the can flange with the can lid flange. For rotation of the can, the can is preferably clamped between the seaming head and the lifting station, whereby the seaming head is rotated about the seaming axis by the seaming shaft.

In the context of the disclosure, the can can be understood to be a rotationally symmetrical container which is sealed by the can sealer and the associated seaming roll. A can can preferably comprise a metal, in particular aluminum or steel.

In principle, the sealer can preferably comprise at least two types of seaming rollers with preferably different seaming profiles (wherein the corresponding sealing head comprises seaming rollers of both types), so that cans can be sealed according to a double-seam principle, in which the cans are generally sealed in two stages. One type of seaming roll is responsible for each stage. The first type of seaming roller makes a pre-seam (first seaming operation), while the second type of seaming roller completely seals the can/the package (second seaming operation).

If the can is clamped in the sealing station between the lifting station and the seaming head, the first seaming operation is performed with the first seaming roller of the sealing station, but the second operation is preferably performed with the second seaming roller of another (adjacent) sealing station. Thus, the seaming rollers of two sealing stations can always be involved when sealing a can.

BRIEF DESCRIPTION OF THE DRAWINGS

The embodiments of the invention will be explained in more detail hereinafter with reference to the drawings.

DETAILED DESCRIPTION

Figure 1:
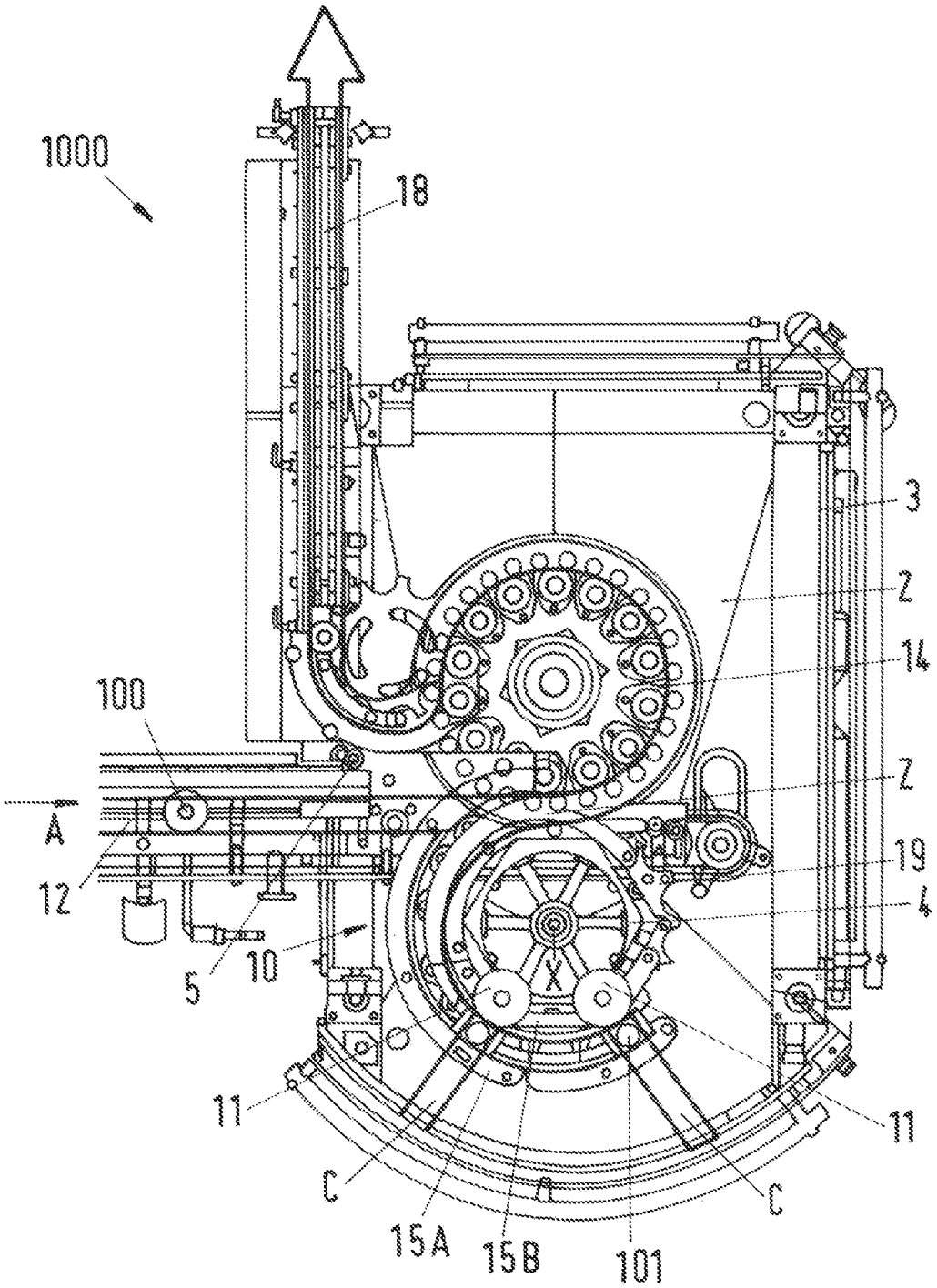
FIG. 1 illustrates a plan view of a can sealer.

FIG. 1 shows a plan view of a can sealer 1000 according to the disclosure.

The can sealer 1000 according to FIG. 1 comprises two lid providing devices 11 for providing a lid 101 to a lid feeder 10, which transports the lids 101 to the can 100. The lid feeder 10 comprises a lid movement device 4 which is arranged in a movable manner in such a way that the lid 101 can be moved to the can 100 by the lid movement device 4. For this purpose, the lid movement device 4 is attached to a shaft and is arranged to be rotatable by this shaft, so that the lid 101 can be moved by a rotation of the lid movement device 4.

In addition, the lid feeder 10 comprises a lid guide 15A, 15B arranged on the lid movement device 4 for guiding the lid 101 to the can 100. For this purpose, the lid guide 15A, has a first rail 15A and a second rail 15B extending parallel to the first rail 15A, wherein the lid 101 is arranged between the rails 15A, 15B in such a way that the lid 101 is guided by the movement of a lid, carrier 19 of the lid movement device 4 between the rails 15A, 15B in the direction of point Z, where the lid 101 is united with the can 100 entering along A from a, container feeder 12.

In addition, the sealer 1000 comprises a seaming process/arrangement 14 having sealing stations in the form of seaming stations for sealing the can 100 with the lid 101. The seaming process 14 is arranged in a working space 2 of the can sealer 1000 surrounded by a housing 3.

The lid 101 is introduced along C by the lid providing device 11 into the working space 2 of the can sealer 1000 and is guided by the lid guide 15A, 13B to the can 100.

However, before the lids are placed on the lid guides 15A, 15B, a de-stacking process takes place in which the lids 101 are individually separated from a stack.

Then, the cans 100 with lids 101 are guided to the seaming process 14. When being fed to the seaming process 14, the can 100 and the lid 101 are gassed by a gassing device 5 arranged stationary at the lid feeder 10 and the container feeder 12. Subsequently, the can 100 is clamped with the lid 101 and sealed by the seaming process 14. The sealed can is conveyed by a further rotor into a can outlet 18.

Figure 2:
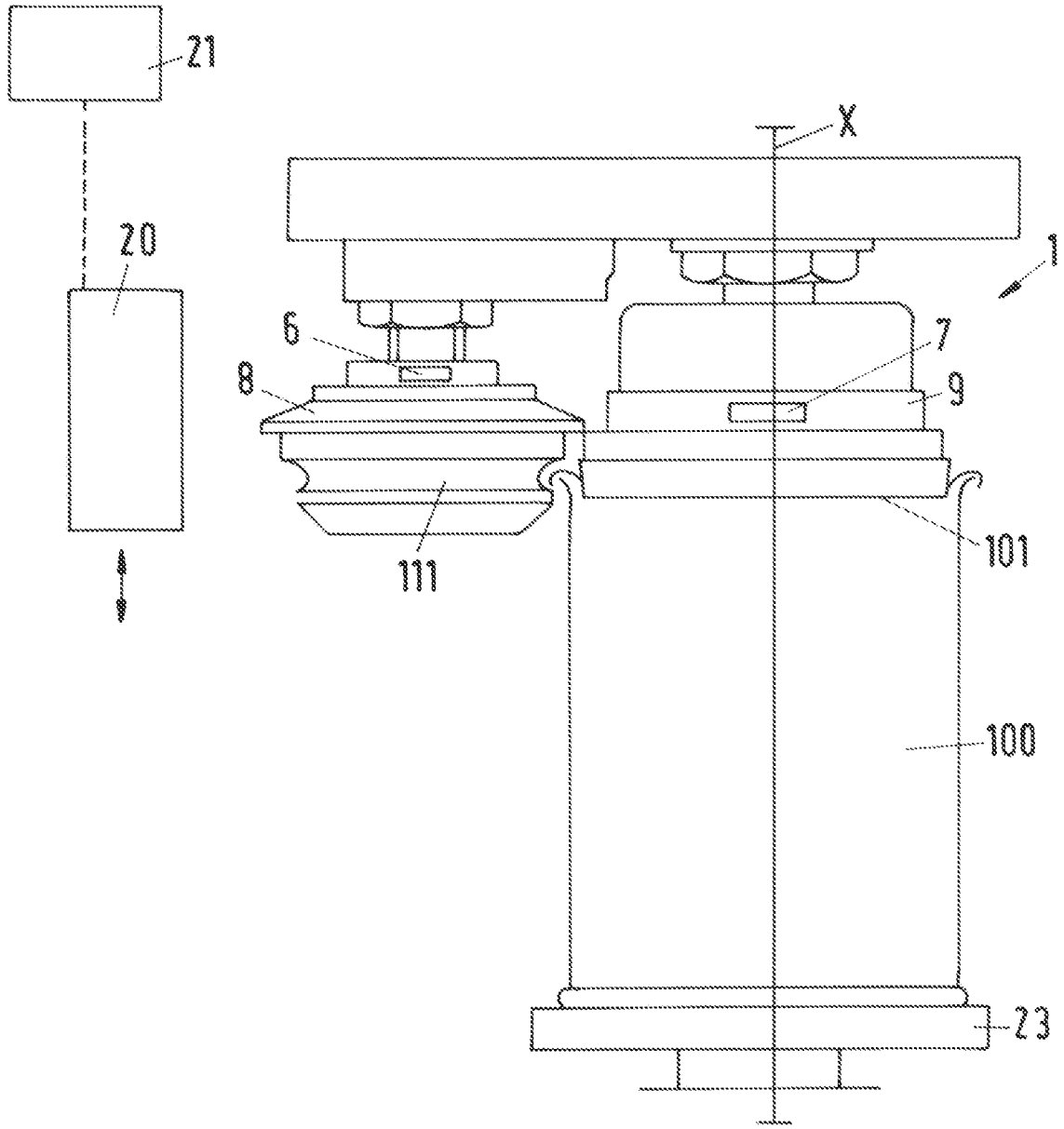
FIG. 2 illustrates a side view of a sealing station.

FIG. 2 shows a schematic representation of a sealing station 1 with the can 100 to be sealed and the can lid 101 in which the control device 21 according to the disclosure is connected to an identification device 20.

The sealing station 1 comprises a can support with a lifting station 23, a seaming head 9 and a seaming roller 8 rotatably mounted about a seaming shaft and having a seaming roll profile 111. The can lid 101 is arranged centered above the can opening 100. The can 100 has a circumferential can flange in the area of the can opening, and the can lid 101 has a circumferential can lid flange.

During the sealing process, the seaming roller 8 is brought into contact with the can flange and the can lid flange via the seaming roller profile 111. In this process, the can flange and the can lid flange are pressed together via the seaming roller 8 by a force acting substantially radially. The pressing is effected by a continuous rolling of the seaming roller 8 in the circumferential direction along the circumference of the can opening.

For seaming, the can 100 is rotated by a clamping device made up of a lifting station 23 and a seaming head 9, by rotating the seaming head 9 by the seaming shaft about the seaming axis X.

A monitoring of the seaming roller 8 and/or the seaming head 9 can be carried out by means the control device (electronic controller) 1.

For this purpose, the seaming roller 8 comprises a first identification element 6 and the seaming head 9 comprises a second identification element 7, by which the seaming roller 8 and the seaming head 9 can be uniquely identified (with respect to seaming rollers/seaming heads of other sealing stations).

The seaming roller 8 and the seaming head 9 are identified by the identification device which moves to the identification elements 6, 7. For this purpose, the identification elements 6, 7 are designed as transponders which are read out.

After reading out, the identification of the seaming roller 8 and the seaming head 9 is stored in the control device 21. Subsequently, a number of cans sealed by seaming roller 8 and seaming head 9 can be monitored.

For this purpose, a counter is stored in each case in the control device 21 for the seaming roller 8 and the seaming head 9.

By counting the can lids 101 by the lid de-stacking device of the sealer, the stored counter can be increased, since the number of the can lids 101 and thus the number of the sealed cans can be determined by the lid de-stacking, device if the sealer is stopped after a production run, the counters of the seaming roller 8 and the seaming head 9 are increased by the corresponding number of cans, in consideration of the number of seaming stations 1.

The disclosure is not limited to the disclosed embodiments. Other variations of the disclosed embodiments can be understood and effected by persons skilled in the art in practicing a claimed disclosure from a study of the drawings, the disclosure, and the dependent claims. In the claims, the word "comprising" does not exclude other elements or steps, and the indefinite article "a" or "an" does not exclude a plurality. The mere fact that certain measures are repeated in mutually different dependent claims does not mean that a combination of these measures cannot be advantageously used. Any reference signs in the claims should not be interpreted as limiting the scope.

The invention claimed is:

1. A method for monitoring seaming tools of a sealer, the method comprising:

providing the sealer with a seaming tool to attach a lid to a container and a controller to control and monitor the sealer;

the seaming tool comprising an identification element by which the seaming tool is capable of being uniquely identified;

identifying the seaming tool by the identification element;

storing the identification of the seaming tool in the controller; and monitoring a number of containers sealed by the seaming tool by the identification stored in the controller, the sealer comprising an identification device configured to be moved to the identification element and identify the seaming tool by the identification element.

2. The method according to claim 1, wherein the identification element is a transponder.

3. The method according to claim 2, wherein the transponder is a passive transponder, and the identification device is designed as a transmitting/receiving unit and provides energy to the passive transponder for identification.

4. The method according to claim 1, wherein the identification element is an onto-electronically readable identification element.

5. The method according to claim 4, wherein the identification device is an opto-electronic reading device and reads the onto-electronically readable identification element for identification.

6. The method according to claim 5, wherein the opto-electronically readable identification element is a bar code or a QR code.

7. The method according to claim 1, wherein a limit value for sealed containers is stored in the controller and a wear signal is output via the controller after the limit value for the seaming tool is reached.

8. The method according to claim 1, wherein the seaming tool comprises a seaming shaft rotatable about a seaming axis and a seaming device arranged at one end of the seaming shaft.

9. The method according to claim 8, wherein the monitoring the number of containers sealed by the seaming tool is carried out by a rotation measurement at the seaming shaft.

10. The method according to claim 9, wherein the seaming shaft is a seaming roller shaft, and the seaming device is a seaming roller configured to seam the lid to the container.

11. The method according to claim 8, wherein the seaming shaft is a seaming head shaft, and the seaming device is a seaming head configured to fix the lid on the container.

12. The method according to claim 8, wherein the monitoring the number of containers sealed by the seaming tool is carried out via a counting of the lids by a lid de-stacking device of the sealer.

13. The method according to claim 12, wherein the seaming shaft is a seaming roller shaft, and the seaming device is a seaming roller configured to seam the lid to the container.

14. A sealer configured to carry out the method according to claim 1.

15. The sealer according to claim 14, comprising the seaming tool configured to attach the lid to the container and the controller configured to control and monitor the sealer, the seaming tool comprising the identification element configured uniquely identify the seeming tool.

16. The sealer according to claim 15, comprising an arrangement arranged in a working space of the sealer with a plurality of sealing stations comprising the seaming tool.

* * * * *